United States Patent [19]

Gelling

[11] 4,214,521

[45] Jul. 29, 1980

[54] ROLLING PARALLEL PRINTER

[75] Inventor: Helmut Gelling, Wangen, Switzerland

[73] Assignee: Firma Precisa AG Rechenmaschinenfabrik, Zurich, Switzerland

[21] Appl. No.: 874,555

[22] Filed: Feb. 2, 1978

[30] Foreign Application Priority Data

Feb. 9, 1977 [DE] Fed. Rep. of Germany ..... 2705435

[51] Int. Cl.[2] ..... B41J 1/44

[52] U.S. Cl. ..... 101/96; 101/297; 101/298; 101/99

[58] Field of Search ..... 101/10, 20, 61, 64, 101/65, 80, 81, 93.22, 93.35, 93.36, 93.41, 94, 297, 95, 298, 96, 99, 195, 197, 200, 255, 263, 270, 291

[56] References Cited

U.S. PATENT DOCUMENTS

| | | | |
|---|---|---|---|
| 2,344,609 | 3/1944 | Hanson | 101/297 |
| 2,613,599 | 10/1952 | Rupp | 101/298 |
| 3,280,739 | 10/1966 | Yow-Jiun-Hu | 101/297 |
| 3,585,929 | 6/1971 | Gopperton | 101/20 X |
| 3,693,473 | 9/1972 | Beachner | 101/297 X |
| 3,721,186 | 3/1973 | Thevis et al. | 101/94 X |
| 3,789,755 | 2/1974 | Gross | 101/95 |
| 3,946,666 | 3/1976 | Yokoyama | 101/99 |
| 3,954,054 | 5/1976 | Busch | 101/93.22 X |

*Primary Examiner*—Edward M. Coven

*Attorney, Agent, or Firm*—Burns, Doane, Swecker & Mathis

[57] ABSTRACT

A rolling parallel printer in which a pressure element is driven through a swiveling motion each printing cycle and a pressure segment thereof rolls off a line of type. The pressure element is connected to a mechanical linkage which minimizes the sweep of travel of the pressure element, while maintaining the pressure element sufficiently far from the type in a rest position to facilitate reading of the printed matter.

9 Claims, 5 Drawing Figures

ROLLING PARALLEL PRINTER

BACKGROUND AND OBJECTS OF THE INVENTION

The invention concerns a rolling parallel printer of the type comprising a plurality of type wheels which are arranged side-by-side on one common shaft, the shaft being fastened to a frame. The wheels can be set at specific positions. A pressure unit performs one periodic swiveling motion per printing cycle and forces the paper strip and the ribbon against the positioned line of types to accomplish the printing. A power drive produces the swiveling motion of the pressure unit.

Two different types of printers have recently been developed, and have become the most important designs for printing, on paper strips, data produced by electronic desk computers.

One of these types is the parallel printer with a reciprocating platen. Printing on the paper strip is accomplished in that the strip and an ink ribbon are pressed by the platen against the type wheels which are set at the specific digit positions.

The second type is the rolling printer wherein a platen of relatively small diameter, its center axle being linked to lever arms, is pivotably driven around a fixed axis. At one point of its rotary path a section of the perimeter of the platen rolls over the sandwiched paper strip and ribbon and the positioned types, in a planetary-type motion.

These two types of printers have both advantages and disadvantages. In case of the first-mentioned type the time required for the printing is short and the required traverse of the swivel can be accomplished in a simple manner by a mechanical drive mechanism. It is also possible to place the platen in its position of rest at such distance from the location of the type wheels that the printed data can be read with ease, while on the other hand a clear print-out requires a very heavy contact pressure which is particularly difficult to attain if carbon copies are needed. The high contact pressure demands not only a relatively strong motive power but also generates an annoying noise. Also, such pressure results in heavy stresses and wear and tear of the mechanical components, especially at the points of bearing and support. One additional advantage is due to the fact that the movements for the feed of the paper and the advance of the ribbon can be coordinated with the movement of the platen in a simple manner.

The known rolling printer, i.e., the second type, on the other hand requires a contact pressure of much lesser strength and produces copies of superior quality, but its printing consumes more time. It requires a relatively large space for the turning of the platen and the visibility of the print-out is poor unless auxiliary steps are introduced, namely backing up the paper by one line prior to the printing and advancing it by two lines after the printing, a procedure which requires a relatively complicated mechanical arrangement.

It is an object of the invention to design a rolling parallel printer in such manner that the disadvantages of the above-described parallel printers will be overcome to a great extent.

It is another object of the invention to provide a rolling printer of the kind which makes use of its superior feature, viz., pressing by means of a pressure unit against the ribbon and the paper, located in front of the positioned line of types in an automatically controlled motion which during the imprint phase accomplishes a rolling operation so that the magnitude of the contact forces can be held to a low value, while at the same time providing good visibility of the printed line.

It is a further object of the invention to provide such a rolling printer wherein despite a relatively wide route traveled by the pressure unit, from the instant of pressure to its position of rest, the travel actually performed by it, is relatively small due to a flattened path of travel.

BRIEF SUMMARY OF THE PREFERRED EMBODIMENT OF THE INVENTION

This invention solves this problem in that the pressure unit is designed in the form of a bridge with lever-legs placed on both sides. Each leg is connected by way of a first joint coupling at its free end with one end of a lever or guide rod. The other end of the is lever pivotably mounted to the frame. The other end of the leg is connected pivotally to a rocking arm at a location near the bridge. The rocking arm is coupled to the rotating pin of a driving crank which is mounted on the frame. The crank performs one revolution per printing cycle. The rocking arm is guided on a frame-crossbar by a slot within the rocking arm. The slot has approximately twice the length of the crank arm. On the bridge, with the type wheels aligned, there protrudes a curved pressure segment which, when the rocking arm is in its foremost position, rolls off the row of types, the latter being positioned and ready for printing. The relative dimensions of the coupling linkage and its pivot points, while it is fastened to the frame, are selected so that the pressure segment will move along a path in the form of an extended ellipse, with an automatically controlled roll-down at the types taking place within one of the zones of the ellipse possessing the smaller radius of curvature.

The guidance of the motion by the pressure unit will be facilitated if the slot within the rocking arm is curved, a crescent-shaped slot being particularly advantageous. In order to attain a compact type of construction of the printer it will further be expedient for the rocking arm to extend below and beyond the type wheel shaft.

In order to insure a uniformly clear print of the exposed types onto the paper, it is advantageous to design the automatically controlled curved pressure segment elastically which will also make it possible to compensate any deviations within the individual type wheels, and will also make allowance for the difference in thickness when several copies are being produced. It has been found that the curved pressure segments are particularly suitable if they are manufacturered from a number of separate plate spring clips, placed side-by-side and formed with a common strip at their rear portion which is mounted within the bridge, an arrangement which facilitates mounting and installation.

The coupling linkage can advantageously be utilized for the support of other necessary operations of the printer. It is possible to arrange at one of the rocking arms a bar link for stepwise ribbon transport. The bar link may be vertically movable against a spring force, so that a special alignment of this bar link with a corresponding opening in a ribbon magazine to be installed will not become necessary during the use of the printer, and so that the bar will become engaged automatically at the first printing cycle.

It is also possible to utilize the printing mechanism to assemble the locking levers for the positioning of the type wheels in an advantageous manner.

THE DRAWING

By using the drawing as a basis, the invention will now be explained in detail by discussing its conception which takes into consideration the kinematics involved, and the details of the design of one preferred embodiment illustrated. In the drawing.

DETAILED DESCRIPTION OF A PREFERRED EMBODIMENT OF THE INVENTION

Figure 1:
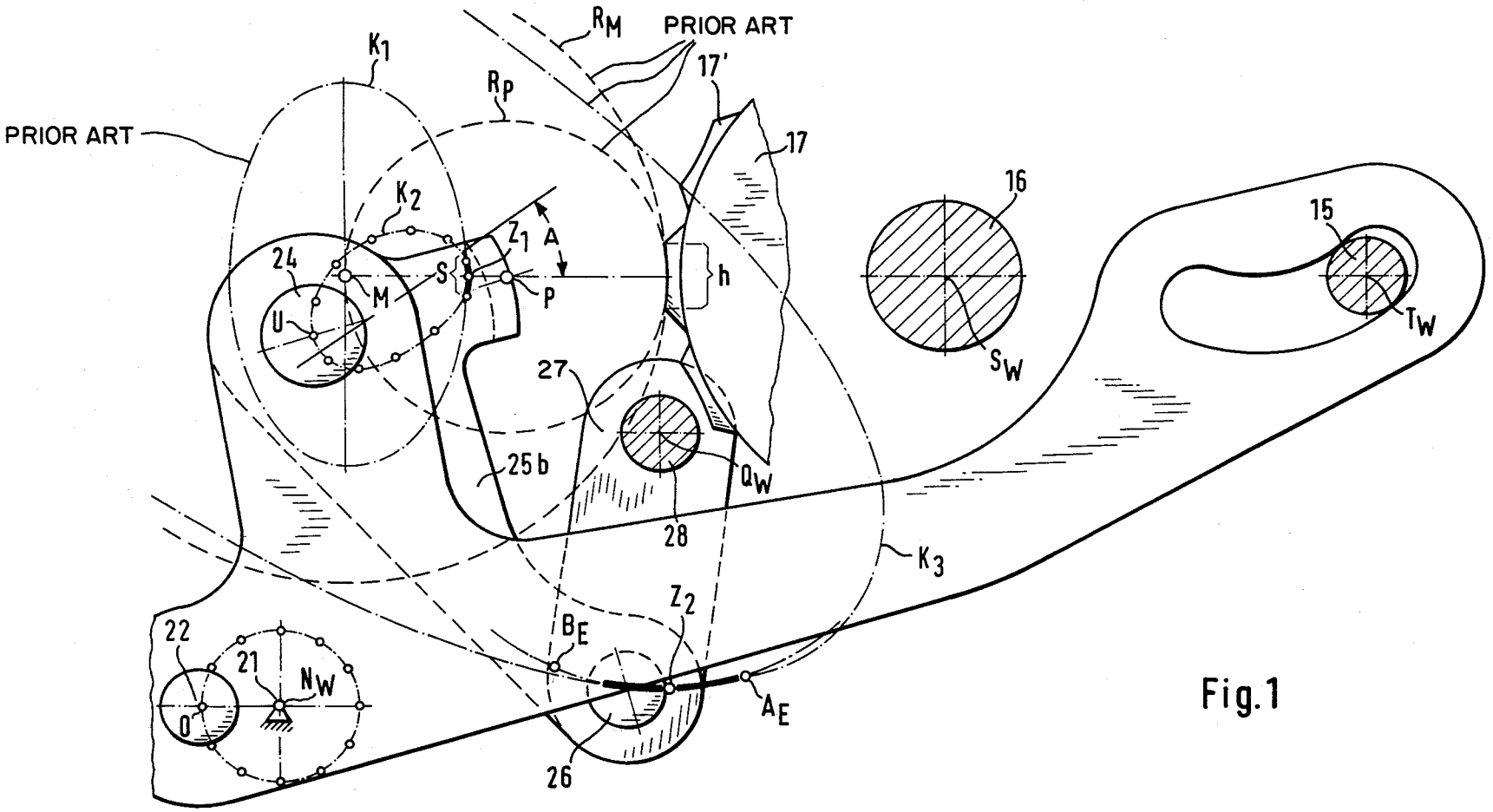
FIG. 1 shows, in side elevational view, the linkage of the rolling printer in an enlarged scale, with the frame of the printer omitted for clarity, and comparing the travel path of the pressure segment of the pressure invention with that of the prior art.
Figure 1A:
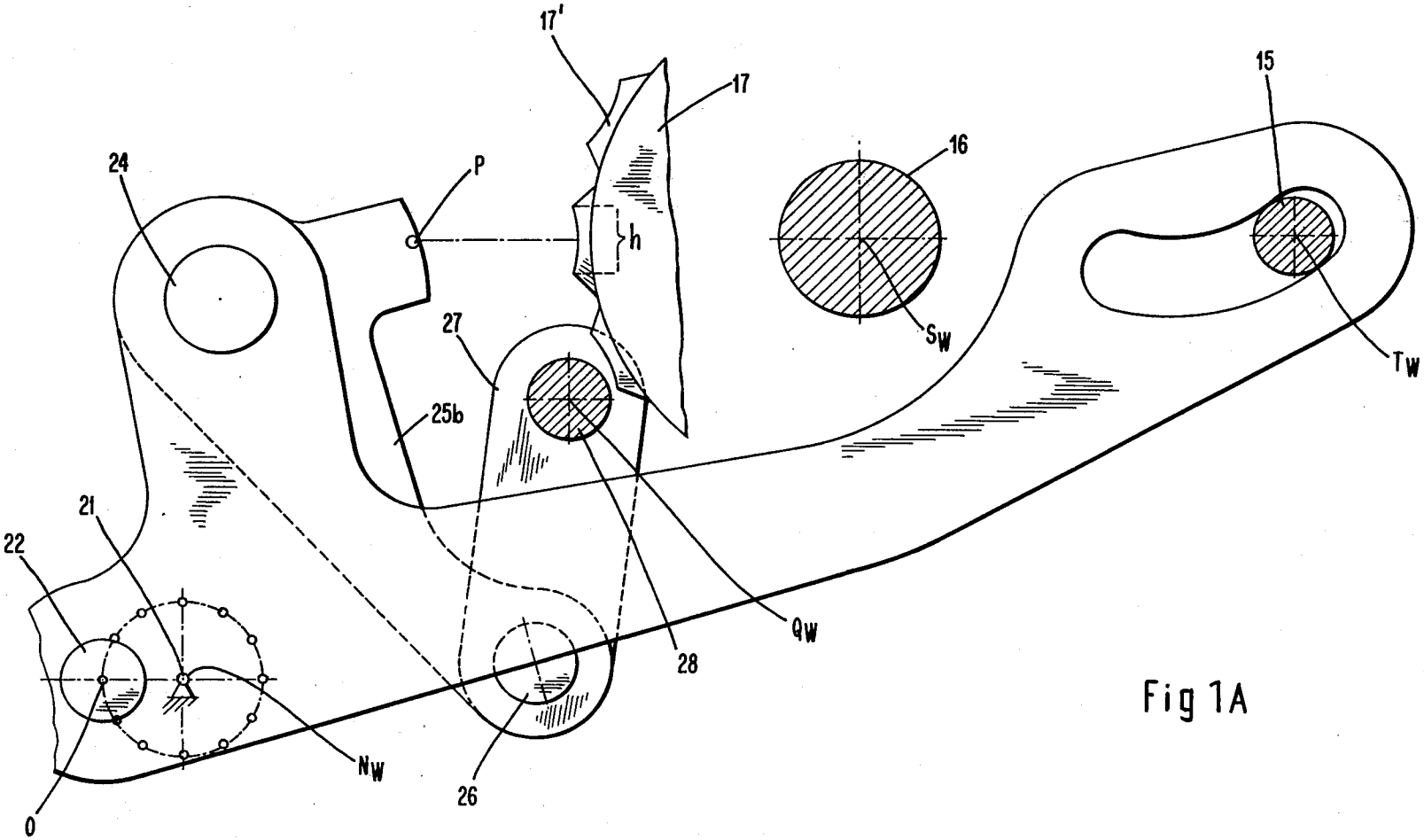
FIG. 1A is a view similar to FIG. 1 but omitting the comparison of the travel path of the pressure segment in the present invention with that of the prior art.

By means of FIG. 1 the train of thoughts will be explained that led to the development of the four-hinge coupling mechanism of the rolling printer of the present invention.

The previously discussed rolling printer of known design uses a pressure cylinder $R_p$, its center axis denoted by P. This cylinder revolves about a point M, the distance between point M and the positioned row of type being equal to the diameter of the pressure cylinder $R_p$ in the case illustrated. Only during the brief period of time when the pressure cylinder $R_p$ is in contact with the row of type will the cylinder roll off the type and turn about its own axis P.

A point $Z_1$ of the pressure cylinder which is located at a certain distance from the axis P passes during this rolling movement over the heavily outlined portion S of a motion-generated ellipse $K_1$. Another point $Z_2$ which is at a specific, greater distance from the axis P of the pressure cylinder passes, during the same period of time, over the heavily outlined portion of a motion-generated curve $K_3$.

The present invention is based on the realization that during the actual printing operation only the heavily outlined portions of the curves $K_1$ and $K_2$ are needed for the pressure unit when rolling off the type. The portion of the curve $K_3$ that is being used by the cylinder can be considered as representing, in approximation, a circular segment so that a steering arm, linked to the frame of the printer, at a certain distance from one point of the segment will be able to travel over such curve portion. It is further feasible to produce the arc S of the curve $K_1$ by means of a four-part linkage, comprising a crank $N_wO$ of a rocking arm $OT_w$ which runs within a slot guide, and the coupling point U. The arc $B_EA_E$, over which the point $Z_2$ must pass, can be produced as a traversing motion about a frame-fixed point $Q_W$ of the steering arm having a length $Q_WZ_2$. The point $Z_1$ will then move along the narrow curved sector $K_2$ during the turning of the crank $N_wO$, and the rounded pressure element of the coupling part $UZ_2$ carries out a motion of rolling off the positioned row of type at the foremost part of its path of travel, that is, the part most closely to the rows of type.

The components of a preferred embodiment of the rolling printer according to the invention for achieving this function will now be discussed. The components illustrated in FIG. 1 carry the same reference symbols as corresponding components shown in FIGS. 2 to 4, the latter figures being used for a more detailed explanation of the invention. Stationary axes are denoted by hatching in these figures for reasons of clarity.

Figure 2:
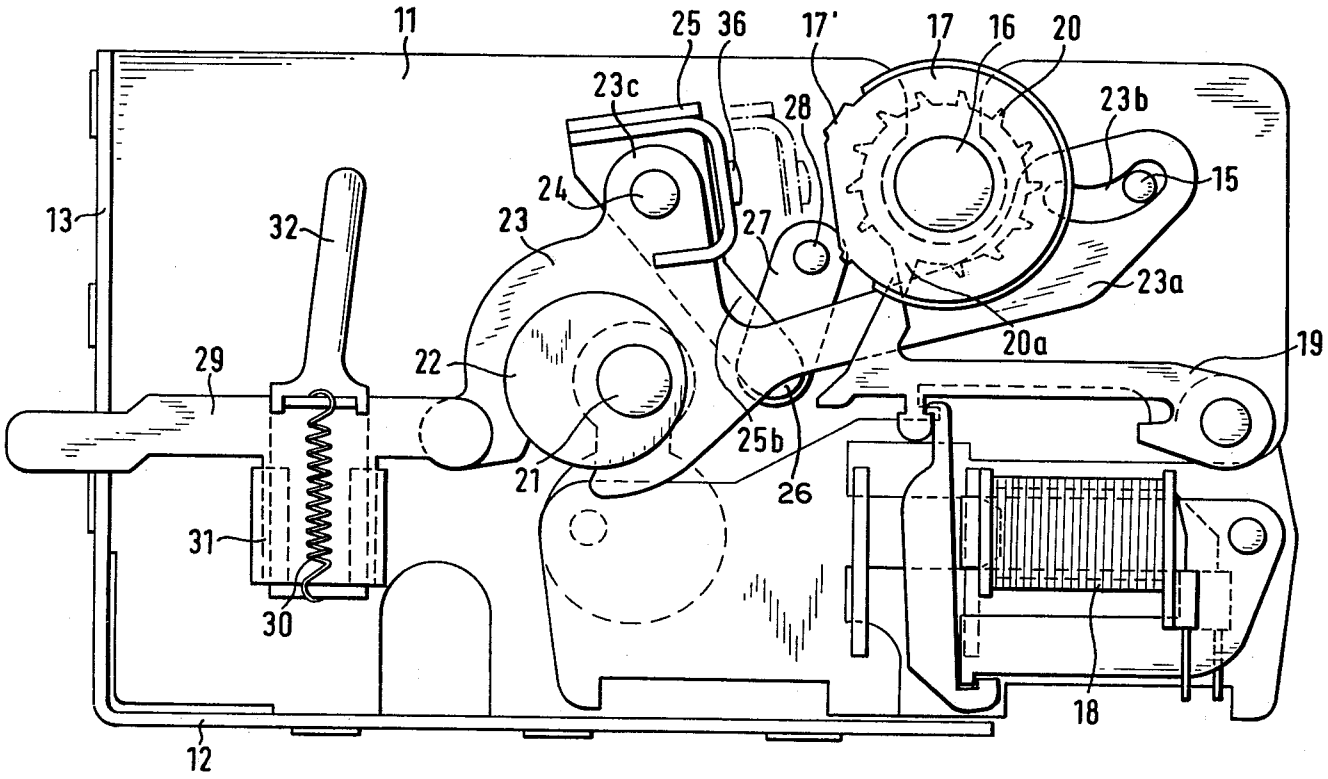
FIG. 2 is a side elevational view of the printer proposed by the invention, with the front wall of the frame removed for clarity.
Figure 3:
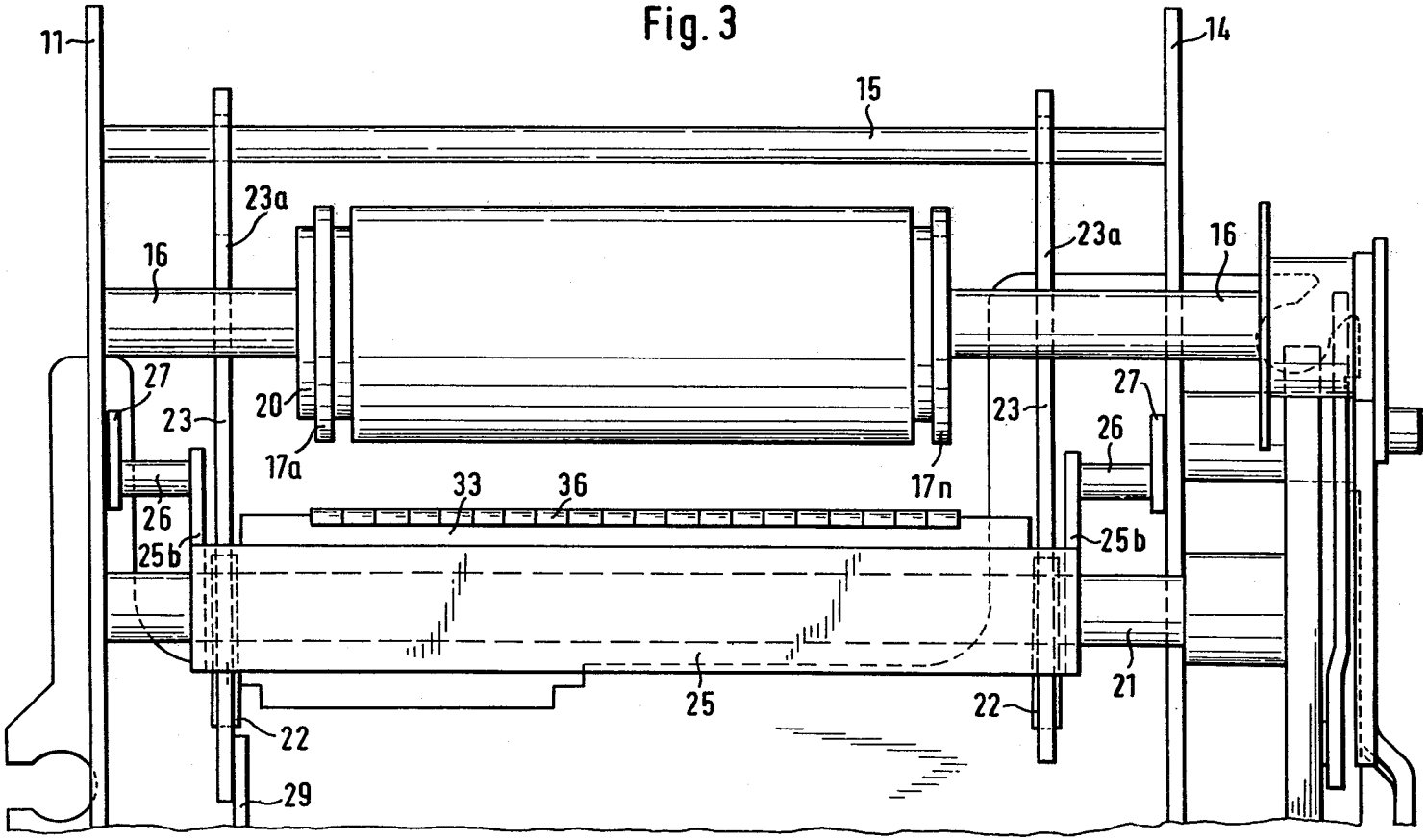
FIG. 3 is a plan view of one portion of the printer depicting type wheels and pressure unit.

FIG. 2 shows the printer in side view, with one side wall removed. FIG. 3 is a plan view of the portion of the printer where the rolling-off motion is produced.

FIG. 2 depicts a side wall 11 of the frame of the printer which is riveted to the frame base 12 and the frame rear wall 13. The base and rear wall are formed from a single piece of material. The other side wall 14, removed in FIG. 2, is visible in FIG. 3. The side walls are connected to each other by a crossbar 15, among other means.

A type wheel shaft 16 is provided which, in a well-known manner, is rotated in forward and rearward time-controlled motion by way of a gearing, whose movements are generated by the printer drive. The shaft is mounted only for rotary motion between the side walls 11 and 14. On the shaft there are lined up, axially supported and secured by frictional forces to the shaft, the type wheels **17*a* to 17*n*. These wheels can be rotated under normal conditions by the type wheel shaft 16. The type wheel shaft 16 can turn with respect to the type wheels when locking levers 19, controlled by electromagnets 18, engage serrations 20 which are provided on every type wheel 17*a* to 17*n*. There is no need to describe in detail the setting of the control magnets 18, and the release and the reassembly of the locking levers 19 because persons skilled in the art are familiar with this system. Of interest is only the feature that the serrations of each wheel include one protruding cog 20*a* at the perimeter which may be contacted by the locking lever 19, even at the time when the locking lever 19 is withdrawn (as in FIG. 2). The purpose for this is that at the conclusion of each printing process all type wheels will be in a normal position, with none of the type 17'** protruding and facing the pressure element.

A drive motor (not illustrated) which is energized for a printing operation rotates by way of a step-down gearing, and a shaft 21 which is rotatably mounted on the frame. The shaft 21 performs one full revolution per printing step. The shaft carries a crank member on each side of the frame. Each crank arm is defined by an eccentric 22 affixed to the shaft. A rocking arm 23 is mounted on each eccentric, and a rocking arm portion **23*a* passes under the type wheel shaft 16 and is provided at its front end with a curved, crescent-shaped slot 23*b* through which passes the crossbar 15 of the frame. The slot 23*b* is located on a side of shaft 16 opposite the shaft 21. The crossbar 15 of the frame is thus utilized as a guide for the rocking arm 23, while the rocking arm, driven by the eccentrics 22**, performs a reciprocating motion.

The distance between the center of shaft 21 and the center of eccentric 22 forms the crank $N_wO$ discussed earlier in connection with FIG. 1. The slot **23*b*** is approximately twice as long as the crank $N_wO$.

Linked to a projection **23*c* of the rocking arm 23*a* is a pressure element 25, the specific design thereof explained in detail in connection with FIG. 4. This linking is effected by means of a cardan shaft 24 which represents the aforementioned coupling point U. The projection 23c extends approximately up to the level of the shaft 16. The pressure element 25 forms a bridge 25a (FIG. 4) having lever legs 25b attached at its sides. Link trunnions 26 extend from free ends of the legs. The pressure element is in articulated connection with levers or guide rods 27, via such trunions 26'. Each rod is suspended within a mounting bore (located in wall 11 or 14 respectively of the frame) by means of a link trunnion 28 carried at its other end. The trunnion 28 forms the linkage point $Q_w$ of the four-hinge coupling mechanism, while the coupling point $Z_2$ is formed by the trunnions 26. The trunnion 28 is located above the trunnion 26 and shaft 21 but below the shaft 16 and pivot 24. The trunnion 26 is at about the same level as shaft 21**.

A slide 29 is guided within a slot of the rear wall 13 of the frame and is pivotably connected with the rear end of the rocking arm. A coupling lug 32 is mounted on this slide and within a guide 31. This lug is vertically movable against the force of a tension spring 30 and serves for the periodic ribbon feed from a ribbon magazine (not illustrated). Locking devices, control and switching elements, for example for the purpose of braking the drive motor, which are not essential for the understanding of the specific movements being performed by the pressure element 25, are not shown in the drawing. Similarly, the mechanism for feeding of the paper is not shown. Such mechanisms are well-known in the art and need not be dealt with here.

A detailed description of the specific movements performed by the pressure element during one turn of the drive shaft 21 is unnecessary in view of the explanations furnished above in connection with the design of the four-hinge linkage mechanism and its purpose. However, FIG. 2 does illustrate the extent of the forward movement of the pressure unit 25 toward the type wheels, and FIG. 1 shows the path through which this movement is performed. As the shaft 21 rotates, the crank member defined by the eccentric 22 causes the rocking arm 23 to be displaced along a path limited and defined by the slot 23b, and by the links defined between the pivots 26, 28 and between the pivots 24, 26. These links and the slot are dimensioned and configured in a manner easily discernable by one skilled in the art to constrain travel of the pressure element to assure that as the pressure unit 25 rolls off the type, the trunnion 26 (point $Z_2$) travels in an arc-like path as defined by the darkened line on elliptical curve $K_3$ in FIG. 1, and the point $Z_1$ travels in an arck-like path defined by the darkened line S on elliptical curve $K_2$ in FIG. 1. During the remainder of the travel of the pressure element, i.e., towards and from the zone of rolling movement, the pressure element is constrained to undergo a minimal amount of sweeping travel. That is, the actual travel distance between the rest or extended position and the point of contact with the type is less, so printing strokes can be effected more frequently. Compare, for example, the shorter curve $K_2$ along which the point $Z_1$ travels according to the present invention, with the longer curve $K_1$ along which it formerly traveled. The pressure point P of the pressure unit 25 travels in a path similar in length and orientation to $K_2$ but situated closer to the type wheels. The long dimension of the elliptical path (curve $K_2$) through which either of the points $Z_1$ and P travel is oriented at an acute angle A in the range of about 15°–60° relative to an imaginary line extending between the retracted pressure point P and the type wheel as viewed in FIG. 1, which imaginary line is substantially horizontal in the disclosed preferred embodiment. This is compared to the long dimension of the path $K_1$ which is almost perpendicular to such imaginary line. It is thus demonstrated that the pressure element, although maintaining at its position of rest a wide distance from the type wheel (which is advantageous for the viewing of the printed line), has no need to swivel at a wide sweep for rolling off the type during the printing operation, so that the contact force can be kept to a low value, and the time for printing is shortened.

Figure 4:
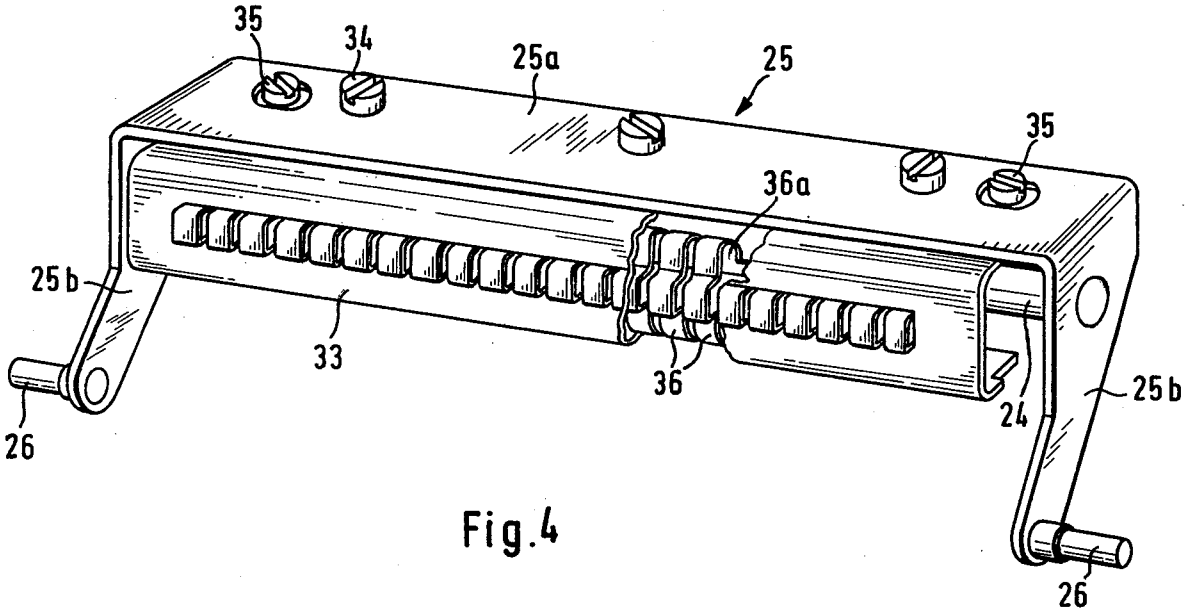
FIG. 4 shows the pressure unit standing alone and with portions cut away.

A preferred form of the pressure element 25, used for the rolling printer proposed by the invention is illustrated in detail in FIG. 4. The bridge 25a, which extends in longitudinal direction parallel to the type wheel axis 16 and which is held by the rocking arm 23 above the shaft 24, carries a U-shaped bar 33 which is bolted to the bridge. Fastening screws 34 pass through oblong perforations of the bridge 25a, with eccentrical adjusting screws 35 allowing a precise positioning of the U-shaped bar 33 relative to the bridge 25 when the fastening screws 34 are loosened. In this manner it becomes possible to compensate for variations at manufacture in order to attain a uniform contact pressure over the entire print line. Variations within the individual type wheels are equalized in that the curved pressure segment is formed by several individual plate spring clips 36 placed side-by-side which protrude partially through a slot within the U-shaped bar 33. Rear parts thereof, located within the U-profile of the bar and supported within the U-shaped bar by a bracket (not illustrated), form one joint strip 36a. This design facilitates installation because the individual spring segments are held together. The clips 36 define the pressure point P of FIG. 1.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a rolling parallel printer of the type comprising a frame, a first shaft mounted to said frame, a plurality of type wheels mounted on said first shaft in side-by-side fashion, said first shaft being rotatable to displace types on said type wheels to specific positions, a pressure element including a curved pressure segment mounted on said frame and adapted for connection to drive means to be driven through one periodic swiveling motion each printing cycle for pressing a paper strip and ribbon against a line of the types on said type wheels, the improvement wherein said pressure element comprises a bridge including lever legs extending from both sides thereof; a pair of rocking arms; each leg connected to one of said rocking arms by a first pivot coupling located adjacent said bridge; a drive shaft mounted on said frame and adapted for connection to the drive means to be rotated one revolution each printing cycle, a pair of crank members mounted on said drive shaft, each rocking arm being mounted to one of said crank members; a crossbar mounted on said frame, each rocking arm including a slot which receives said crossbar, the length of said slot being about twice the length of said crank member and arranged to guide said rocking arm as the latter is displaced by said crank member toward a foremost position in which said pressure segment rolls off said line of types, a pair of levers each pivoted at one end to said frame and at another end to one of said legs at a location spaced from said first pivot coupling; said crank member, rocking arm, leg, and lever defining linkage means for displacing said pressure segment in an elliptical path of travel toward and away from the type wheels wherein said pressure segment is oriented parallel to the line of types throughout travel of said segment in said elliptical path and rolls off a line of types when the rocking arm is in said foremost position.

2. A printer as defined in claim 1, wherein said slot within the rocking arm is crescent-shaped.

3. A printer as defined in claim 1, wherein the rocking arm extends underneath said first shaft.

4. A printer as defined in claim 1, wherein the curved pressure segment is resilient.

5. In a rolling parallel printer of the type comprising a frame, a first shaft mounted to said frame, a plurality of type wheels mounted on said first shaft in side-by-side fashion, said first shaft being rotatable to displace types on said type wheels to specific positions, a pressure element including curved pressure segment means mounted on said frame and adapted for connection to drive means to be driven through one periodic swiveling motion each printing cycle for pressure a paper strip and ribbon against a line of the types on said type wheels, the improvement wherein said pressure element comprises a bridge including lever legs extending from both sides thereof; a pair of rocking arms; each leg connected to one of said rocking arms by a first pivot coupling located adjacent said bridge; a drive shaft mounted on said frame and adapted for connection to the drive means to be rotated one revolution each printing cycle, a pair of crank members mounted on said drive shaft, each rocking arm being mounted to one of said crank members; a crossbar mounted on said frame, each rocking arm including a slot which receives said crossbar, the length of said slot being about twice the length of said crank member and arranged to guide said rocking arm as the latter is displaced by said crank member toward a foremost position in which said pressure segment means rolls off said line of types; a pair of levers each pivoted at one end to said frame and at another end to one of said legs at a location spaced from said first pivot coupling; said crank member, rocking arm, leg, and lever defining linkage means for displacing said pressure segment means in an elliptical path of travel toward and away from the type wheels wherein said pressure segment means rolls off a line of types when the rocking arm is in said foremost position, the curved pressure segment means being resilient and comprising several individual plate spring clips placed side-by-side, their rear portion forming a common joint strip.

6. A printer according to claim 5, wherein said curved pressure segment means comprises a plurality of pressure segments, said linkage means is arranged to maintain said pressure segments oriented parallel to the line of types throughout travel of said segments in said elliptical path.

7. In a rolling parallel printer of the type comprising a frame, a first shaft mounted to said frame, a plurality of type wheels mounted on said first shaft in side-by-side fashion, said first shaft being rotatable to displace types on said type wheels to specific positions, a pressure element including a curved pressure segment means mounted on said frame and adapted for connection to drive means to be driven through one periodic swiveling motion each printing cycle for pressing a paper strip and ribbon against a line of the types on said type wheels, the improvement wherein said pressure element comprises a bridge including lever legs extending from both sides thereof; a pair of rocking arms; each leg connected to one of said rocking arms by a first pivot coupling located adjacent said bridge; a drive shaft mounted on said frame and adapted for connection to the drive means to be rotated one revolution each printing cycle, a pair of crank members mounted on said drive shaft, each rocking arm being mounted to one of said crank members; a crossbar mounted on said frame, each rocking arm including a slot which receives said crossbar, the length of said slot being about twice the length of said crank member and arranged to guide said rocking arm as the latter is displaced by said crank member toward a foremost position in which said pressure segment means rolls off said line of types, a pair of levers each pivoted at one end to said frame and at another end to one of said legs at a location spaced from said first pivot coupling; said crank member, rocking arm, leg, and lever defining linkage means for displacing said pressure segment means in an elliptical path of travel toward and away from the type wheels wherein said pressure segment means rolls off a line of types when the rocking arm is in said foremost position, said elliptical path including a long dimension which lies in an acute angle relative to an imaginary line extending from the pressure segment means to the axis of the type wheels when the pressure segment means is in a non-activated rest position.

8. A printer as defined in claim 7, wherein said acute angle is in the range from about 15° to 60°.

9. A printer according to claim 7, wherein said curved pressure segment means comprises a plurality of pressure segments, said linkage means is arranged to maintain said pressure segments oriented parallel to the line of types throughout travel of said segments in said elliptical path.

* * * * *